US009498052B2

(12) United States Patent
Habinger

(10) Patent No.: US 9,498,052 B2
(45) Date of Patent: Nov. 22, 2016

(54) TOOTHBRUSH

(76) Inventor: René Habinger, Vienna (AT)

( * ) Notice: Subject to any disclaimer, the term of this patent is extended or adjusted under 35 U.S.C. 154(b) by 619 days.

(21) Appl. No.: 13/498,139

(22) PCT Filed: Sep. 28, 2010

(86) PCT No.: PCT/AT2010/000352

§ 371 (c)(1),
(2), (4) Date: Mar. 24, 2012

(87) PCT Pub. No.: WO2011/035359

PCT Pub. Date: Mar. 31, 2011

(65) Prior Publication Data

US 2012/0183344 A1 Jul. 19, 2012

(30) Foreign Application Priority Data

Sep. 28, 2009 (AT) ..... A 1524/2009

(51) Int. Cl.
*A46B 11/00* (2006.01)
*A46B 5/00* (2006.01)

(52) U.S. Cl.
CPC ..... *A46B 11/002* (2013.01); *A46B 5/0066* (2013.01); *A46B 11/00* (2013.01); *A46B 11/001* (2013.01); *A46B 11/0041* (2013.01); *A46B 2200/1066* (2013.01)

(58) Field of Classification Search
USPC ..... 401/183–186, 188 R; 222/207, 209, 222/210, 213, 527, 529, 533, 536
See application file for complete search history.

(56) References Cited

U.S. PATENT DOCUMENTS

| | | | | |
|---|---|---|---|---|
| 2,738,615 | A * | 3/1956 | Childs et al. | 222/633 |
| 3,300,099 | A * | 1/1967 | Marona | 222/207 |
| 4,474,313 | A * | 10/1984 | Sieverding | 222/211 |
| 7,789,583 | B2 * | 9/2010 | Kuo | 401/188 R |
| 7,922,042 | B2 * | 4/2011 | Rossignol | 222/207 |

* cited by examiner

*Primary Examiner* — David Walczak

(57) ABSTRACT

A brush, in particular toothbrush, comprises an upper part (1) and a lower part (2) which are interconnected by means of an articulation (3). A storage chamber (6) for a liquid or pasty medium, in particular toothpaste, is provided in the lower part (2) and a brush head (4) is disposed on the upper part (1). A channel (11) extends between the storage chamber (6) and the brush head (4), which channel is continuously always open from the storage chamber (6) to the brush head (4). The upper part (1) and the lower part (2) have flexurally rigid wall sections (16, 17) which are interconnected via the articulation (3). An elastic wall section (13) is disposed between the flexurally rigid wall sections (16, 17), which forms a wall section (13) of the storage chamber (6).

13 Claims, 4 Drawing Sheets

Figure 1:
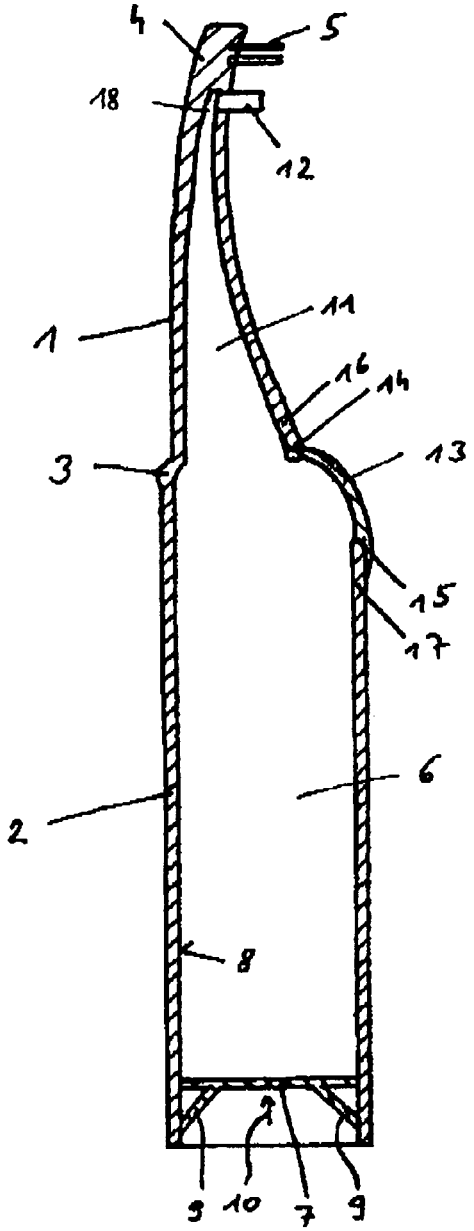

Fig. 2
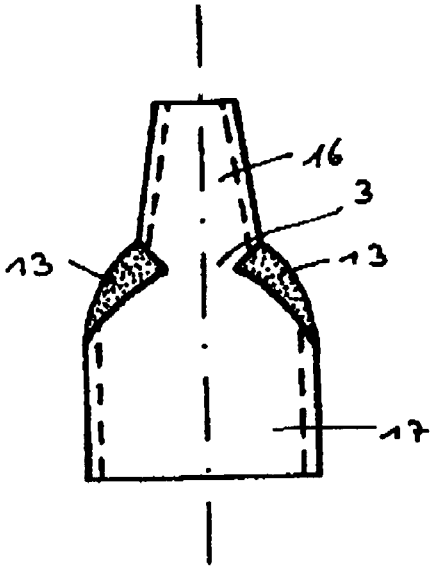
Fig. 3
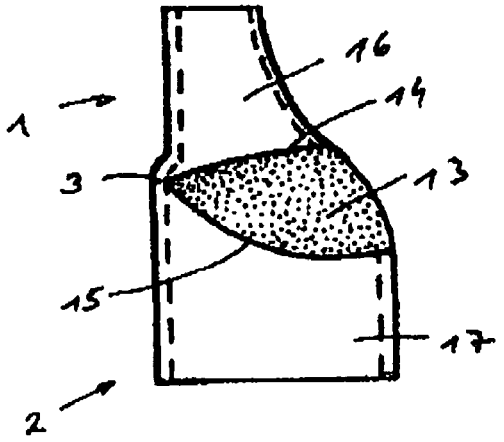
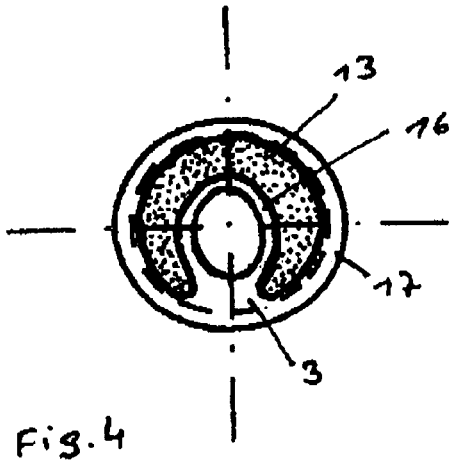
Fig. 4

TOOTHBRUSH

The Invention relates to a brush, in particular a toothbrush, comprising an upper part and a lower part which are interconnected by means of an articulation, where a storage chamber for a liquid or pasty medium, in particular toothpaste, is provided in the lower part and a brush head is disposed on the upper part, and where a channel extends between storage chamber and brush head.

Such a toothbrush is known from EP 933 044 A. A disadvantage of this toothbrush is that it consists of relatively many parts and therefore is expensive to manufacture. It is therefore the object of the invention to provide such a toothbrush which consists of few parts and therefore is simpler and more favourable to manufacture.

This object is solved by a toothbrush of the type specified initially whereby a device is disposed in the channel which impedes or prevents a flow of the medium from the brush head to the storage chamber, the upper part and the lower part have flexurally rigid wall sections which are interconnected via the articulation and an elastic wall section is disposed between the flexurally rigid wall sections, which forms a wall section of the storage chamber. Such a device can be installed very simply in the upper part.

A preferred embodiment of the invention is characterized in that the storage chamber on the side opposite the upper part is delimited by a base part which is only movable in the direction of the upper part and that the channel from the storage chamber to the brush head is continuously always open and that a cross-sectional narrowing is provided in the channel which produces a flow resistance that is greater than the movement resistance of the base part in the direction of the brush head. In this way, the back flow of the medium into the storage chamber is impeded.

The pumping process is executed, as is known per se from EP 933 044 A, by pivoting the upper part with respect to the lower part. By pivoting the upper part with respect to the lower part, the storage chamber is made smaller in the area of the elastic wall section so that the medium is pressed through the channel to the brush head.

It has been found that with a suitable dimensioning of the channel connecting the storage chamber to the brush head, valves or similar fixtures can be completely dispensed with. The channel must only have such a narrow channel, at least in sections so that at a given viscosity of the medium used, a sufficient flow resistance is present which prevents excessive back flow of the medium when the upper part is unbent again or stretched with respect to the lower part after a pumping process.

Alternatively it is also possible to install a valve in the upper part.

Since the volume of the storage chamber would enlarge again when unbending the upper part, volume compensation must be provided by suitable measures, for example, whereby the storage chamber on the side opposite the upper part is delimited by a base part which is only movable in the direction of the upper part since otherwise the medium would be sucked back from the channel again.

In order to ensure a reliable pumping effect, the upper part and the lower part comprise flexurally rigid wall sections which are interconnected via the articulation and between which the elastic wall section is disposed.

In one embodiment of the invention which is constructively simple and easy to manufacture, the flexurally rigid wall sections and the articulation are formed from a one-piece part. They can thus be manufactured in a single injection moulding process where the articulation can be executed in a manner known per se, for example, as a film hinge.

In a preferred embodiment of the invention the channel is delimited directly by the flexurally rigid wall sections and the elastic wall section. That is, no further protective or dividing layers are present between the flexurally rigid wall sections and the elastic wall section, which further simplifies manufacture.

In a particularly preferred embodiment, the lower part and the upper part with its flexurally rigid section can be formed from one-piece parts and delimit the storage chamber or the channel.

If the lower part and the upper part and also the articulation are formed from a one-piece part, in a simplest embodiment the entire brush, apart from the movable base part and the bristles on the brush head, can be made from a single part to which only the elastic wall section need be applied, which can be simply executed by a second Injection moulding process.

The width of the articulation is inter ails dependent on the diameters of the upper part and the lower part and its length and subsequently naturally on the desired stability of the articulation with respect to lateral bending.

In the invention it is preferred if the width of the articulation is between ⅙ and ½, preferably about ⅓ of the diameter of the lower part and/or if the width of the articulation is between ⅕ and ⅔, preferably about ½ of the diameter of the upper part. These dimensions ensure sufficient stability of the articulation and functionality of the brush for the usual dimensions of such brushes.

Figure 5:
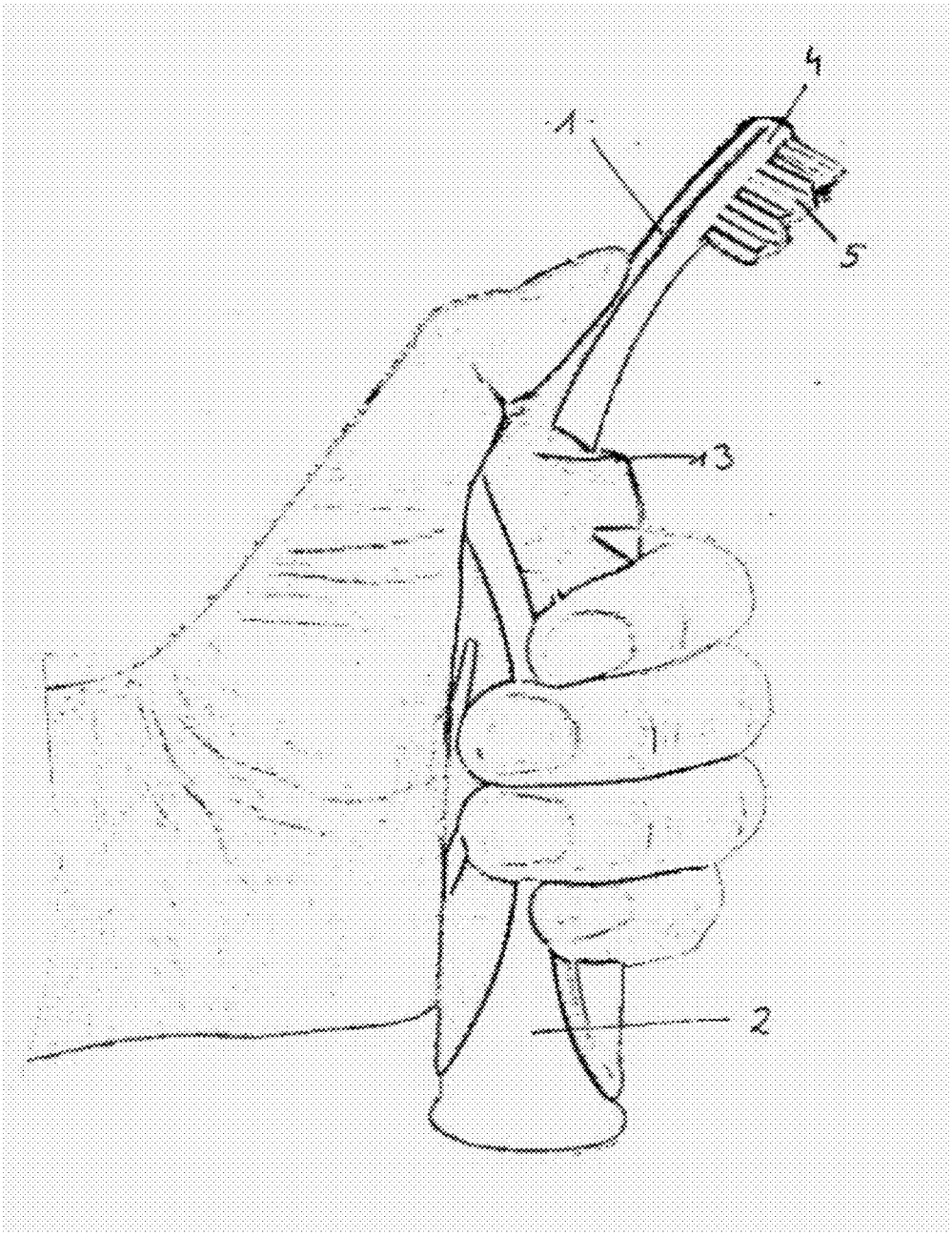
Figure 6:
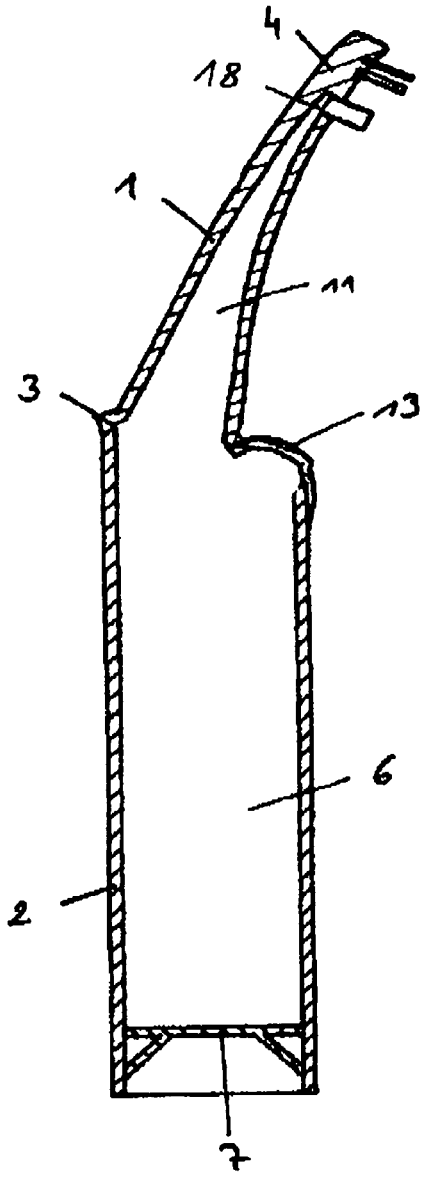

Further features and advantages of the invention are obtained from the following description of preferred exemplary embodiments of the invention with reference to the drawings. In the figures:

FIG. 1 shows a brush according to the invention in section,

FIG. 2 shows the central region of the brush in the area of the articulation from behind, FIG. 3 shows the central region of the brush in the area of the articulation from the side, FIG. 4 shows the central region of the brush in the area of the articulation from above, FIG. 5 shows the brush whilst it is bent for a pumping process and FIG. 6 shows a section through the brush whilst it is bent for a pumping process.

The brush according to the invention comprises an upper part 1 and a lower part 2 which are interconnected via an articulation 3. The upper part 1 and the lower part 2 are made of a hard and flexurally rigid material, and are preferably manufactured in one piece with the articulation 3 which can be executed in the manner of a film hinge. Located at the upper and of the upper part 1 is a brush head 4 with bristles 5 whose number and length are dependent on the desired intended use in each case.

The lower part 2 is cylindrical and encloses a storage chamber 6 which Is delimited on the side opposite the upper part 1 by a base part or piston 7. The base part 7 is ideally a part sliding on the inner surface 8 of the wall of the lower part 2 which is movable, for example, by suitably shaped ribs on the Inner surface 8 and/or dews 9 or the like, only in the direction of the arrow 10 towards the upper part 1, whereas any movement in the other direction is prevented by the ribs and/or claws 9.

The upper part 1 delimits a channel 11 which narrows towards the brush head 4, which extends from the storage chamber 6 to the brush head and has its smallest cross-section at the end 18. If desired, an extension in the form of a small elastic tube 12 can be provided at the end of the channel 11, on the one hand, in order to be able to additionally adjust the flow resistance following the channel 11 and on the other hand, in order to be able to convey the medium further towards the end of the bristles 5. The small tube can have a similar function to a valve if it is sufficiently elastic to be able to be folded together.

Located between the hard and flexurally rigid upper and lower parts 1, 2 in the region of the articulation 3 is an elastic wall section 13 which on the one hand adjoins the edges 14, 15 of the flexurally rigid wall sections 16 and 17 of the upper part 1 and the lower part 2 and on the other hand adjoins the articulation 13. The elastic wall section 13 which, for example, consists of a thermoplastic elastomer, can be moulded directly on to the wall sections 18 and 17 by an injection moulding process known per se and thus be undetachably connected thereto.

In order to convey a specific amount of a medium, for example toothpaste, from the storage chamber 6 to the brush head 4 or to the bristles 5, the upper part 1 is bent with respect to the lower part 2, as shown in FIGS. 5 and 6. In the case, the upper part 1 bends at the articulation 3 with respect to the lower part 2 and presses a part of the elastic wall section 13 as well as, to a certain extent, the flexurally rigid section 16 adjoining the edge 14 into the storage chamber 6 to some extent. Since the base part 7 cannot escape downwards, the medium is pressed through the channel 11 and the small tube 12 to the or between the bristles 5. If the upper part 1 is released, this is moved back into its initial position by the elastic wall section 13, where the elastic wall section 13 at the same time moves outwards again and the volume in the storage chamber 6 would therefore increase. The flow resistance in the channel 11, in the exemplary embodiment shown primarily the flow resistance in the area of the brush head 4, is so great that the medium is not sucked back through the channel 11. On the contrary the flow resistance and the motion resistance of the base part 7 are adjusted to one another so that the base part 7 is sucked a small amount in the direction of the arrow 10.

It cannot be seen in FIGS. 1, 3 and 6 that the flexurally rigid wall section of the upper part 1 and the lower part 2 adjoining the articulation 3 are offset with respect to one another approximately by the wall thickness of the wall sections. This arrangement improves the pumping effect of the brush according to the invention. However it is also feasible that the wall sections are offset even further or less far with respect to one another than that shown in the drawings. It is also possible that the wall sections are aligned flush with respect to one another in the area of the articulation 3.

In the exemplary embodiment shown, the flow resistance of the channel 11 is primarily determined by the flow resistance in the area of the brush head 4. It is naturally also possible to add measures, e.g. a valve, which influence the flow resistance in the channel 11, alternatively or additionally at other places in the channel 11.

If there are problems when first pumping the medium in a, for example, new brush with empty channel, the channel 11 can be filled by pressing on the base part 7 until the backflow resistance in the channel 11 is so large that the medium is not sucked back from the channel 11 but the base part 7 is sucked in the direction of the arrow.

The invention claimed is:

1. A toothbrush, comprising an upper part and a lower part which are interconnected by means of an articulation, wherein a storage chamber for a liquid or pasty medium, is provided in the lower part, a brush head being disposed on the upper part, a channel extending between the storage chamber and the brush head, a device being disposed in the channel which impedes a flow of the medium from the brush head to the storage chamber, the upper part and the lower part having flexurally rigid wall sections which are interconnected via the articulation, an elastic wall section being disposed between the flexurally rigid wall sections, which forms a wall section of the storage chamber, the flexurally rigid wall sections, the flexurally rigid wall sections and the articulation being formed from a one-piece part and that the articulation being a film hinge wherein the elastic wall section comprises a material less rigid than a material used to make the one-piece flexurally rigid wall section and the articulation.

2. The brush according to claim 1, wherein the storage chamber on a side opposite the upper part is delimited by a base part which is only movable in the direction of the upper part.

3. The brush according to claim 2, wherein the channel extending from the storage chamber to the brush head is continuously always open and wherein the device is a cross-sectional narrowing provided in the channel which produces a flow resistance that is greater than a movement resistance of the base part in the direction of the brush head.

4. The brush according to claim 1, wherein the channel delimited directly by the flexurally rigid wall sections and the elastic wall section.

5. The brush according to claim 1, wherein the lower part with its flexurally rigid section is formed from a one-piece part and delimits the storage chamber.

6. The brush according to claim 1, wherein the upper part with its flexurally rigid section is formed from a one-piece part.

7. The brush according to claim 1, wherein the flexurally rigid wall sections, the articulation and the elastic wall section are non-detachably interconnected by an injection moulding process.

8. The brush according to claim 1, wherein the flexurally rigid wall sections are substantially in alignment with one another in the area of the articulation.

9. The brush according to claim 1, wherein the flexurally rigid wall section of the upper part is offset with respect to the flexurally rigid wall section of the lower part in the area of the articulation towards the longitudinal axis of the lower part.

10. The brush according to claim 9, wherein the flexurally rigid wall section of the upper part is offset with respect to the flexurally rigid wall section of the fewer part in the area of the articulation by approximately the wall thickness of the wall sections towards the center of the brush.

11. The brush according to claim 1, wherein the width of the articulation is between ⅙ and ½, preferably about ⅓ of the diameter of the lower part.

12. The brush according to claim 1, wherein the width of the articulation is between ⅕ and ⅔, preferably about ½ of the diameter of the upper part.

13. The brush according to claim 1, wherein the device is a value is disposed in the channel.

* * * * *